US007034229B2

(12) United States Patent
Victor

(10) Patent No.: US 7,034,229 B2
(45) **Date of Patent: *Apr. 25, 2006**

(54) AUDIO AND VIDEO SIGNAL CABLE

(76) Inventor: Jay Victor, 400 Esplanade, Unit 3, Redondo Beach, CA (US) 90277

( * ) Notice: Subject to any disclaimer, the term of this patent is extended or adjusted under 35 U.S.C. 154(b) by 49 days.

This patent is subject to a terminal disclaimer.

(21) Appl. No.: 11/049,062

(22) Filed: Feb. 2, 2005

(65) Prior Publication Data

US 2006/0027392 A1 Feb. 9, 2006

Related U.S. Application Data

(63) Continuation-in-part of application No. 10/619,441, filed on Jul. 16, 2003, now Pat. No. 6,969,805.

(51) Int. Cl.
*H01B 7/00* (2006.01)

(52) U.S. Cl. ..... 174/110 R; 174/113 R; 174/115

(58) Field of Classification Search ..... 174/36, 174/110 R, 113 R, 113 A, 113 C, 114, 115, 174/116, 117 R, 117 F, 117 FF, 119 R
See application file for complete search history.

(56) References Cited

U.S. PATENT DOCUMENTS

| | | | | |
|---|---|---|---|---|
| 2,200,776 | A * | 5/1940 | Hoover | 156/55 |
| 2,386,753 | A * | 10/1945 | Shield | 174/36 |
| 4,628,151 | A * | 12/1986 | Cardas | 174/114 R |
| 4,777,324 | A * | 10/1988 | Lee | 174/34 |
| 5,408,560 | A * | 4/1995 | Seynhaeve et al. | 385/101 |
| 5,516,986 | A * | 5/1996 | Peterson et al. | 174/113 C |
| 5,976,070 | A * | 11/1999 | Ono et al. | 600/110 |
| 6,388,188 | B1 * | 5/2002 | Harrison | 174/27 |
| 6,495,763 | B1 * | 12/2002 | Eichmann et al. | 174/113 R |
| 2004/0045731 | A1 * | 3/2004 | Garland | 174/36 |
| 2005/0011667 | A1 * | 1/2005 | Lee et al. | 174/128.1 |

* cited by examiner

*Primary Examiner*—William H. Mayo, III
(74) *Attorney, Agent, or Firm*—Trojan Law Offices

(57) ABSTRACT

An audio and video signal cable consisting of parallel arrayed conductors having different geometric shapes and cross-sectional areas. Each conductor is individually insulated and all conductors are surrounded by a common insulation. Tinsel, enamel covered wire, or 100% fiber covered copper can be utilized as conductors.

16 Claims, 2 Drawing Sheets

AUDIO AND VIDEO SIGNAL CABLE

This application is a continuation-in-part of and claims the benefit of the priority date of my application, Ser. No. 10/619,441, filed Jul. 16, 2003, now U.S. Pat. No. 6,969,805, and incorporates the teachings of that application as if fully set forth herein.

FIELD OF THE INVENTION

The invention herein relates generally to electric cables, and more particularly, to signal carrying cables incorporating a plurality of conductors having different cross-sectional geometric shapes that provide for the transmission of audio signals.

BACKGROUND OF THE INVENTION

It is widely known that electric wires and cables utilize conductors for the transmission of signals. Typically, the cross-sectional area of conductors used in a wire or cable is chosen in view of the expected magnitude of transmission current. In a conventional audio and video signal cable, the cross-sectional area is based on three main considerations. The first is the amount of transmission current, the second is the tensile strength needed, and the third is the outer diameter required. After the conductor cross-sectional areas are calculated, other factors are considered to select the differing diameters of the conductors.

The diameter of the conductors is also typically chosen to minimize the phenomenon known as skin effect, which is present when electrical current is transmitted through wire. Briefly, when current flows through a conductor, a magnetic field is generated around the circumference of the wire. As frequency increases, the magnetic field shifts more of the electrons towards the surface of the conductor such that an electron "vacuum" results inside the middle of the conductor; no electrons pass through the center of the conductor.

Therefore, smaller diameter conductors are typically utilized for high frequency signal transmission because there is very little or no space for electron passage in lesser diameter conductors. Several approaches have been previously utilized in the art to provide a signal cable with improved transmission efficiency.

U.S. Pat. No. 4,628,151 to Cardas for a multi-strand conductor cable recognizes that the use of a variety of different sized electrical conductors, each individually insulated from one another within a cable wherein the sizes of the various conductors vary one to another according to a predetermined ratio. A common input is provided to each conductive strand at one end of the cable and a similar single connection to each of the conductive strands at the output end of the cable. Cardas teaches that the employment of different sized individual conductive strands within the cable according to the predetermined golden section ratio produces significantly improved efficiency in the transmission of signals from one end of the cable to another.

U.S. Pat. No. 6,495,763 to Eichmann, entitled "Specific Cable Ration for High Fidelity Audio Cables," describes an audio cable where the mass in the return conductor is increased in relation to the mass of the signal conductor by a specific ratio. Basically, Eichmann teaches that the use of a specific ratio of diameters and cross-sectional areas between the signal and the return provides a faster pathway for electrons to travel.

In conventionally used electric wire, the center conductor is typically a single conductor, and if the conductor is too narrow, electrical resistance increases. However, if the conductor is too large, then high frequency signal passage is difficult.

The problem with the cables known in the art is that these cables utilize conductor shapes and materials that are not designed to effectively carry more than one type of signal frequency. For example, although it is known that signal carrying cables can comprise conductor strands other than round, i.e., square, flat, rectangular, etc., in a typical currently known cable, all of the conductors have the same shape.

When such cables are used to simultaneously transmit at different bands of frequency (i.e., high, medium, and low frequencies), the problem of phase difference occurs, and also there may be differences in amplitude throughout the audio frequency range. Due to skin effect issues, and differences in wire gauges, different frequency ranges may be reproduced with varying degrees of accuracy and amplitude, and some interference may take place between different frequency ranges causing loss of definition.

Accordingly, there is a need for a for a multi-core audio/video signal cable that is capable of providing a balanced high, medium and low frequency response, as well as better definition.

SUMMARY OF THE INVENTION

The invention disclosed herein utilizes several signal carrying conductors having various geometric shapes and cross-sectional areas, which enables the cable of the invention to efficiently handle different frequency band signal transmission and as such, takes full advantage of skin effect while achieving total frequency requirements. It is the combination of these different geometric shapes, used in the same cable as a composite conductor that makes this invention unique and novel.

The objective of the invention herein is to provide an audio and video signal cable capable of solving the technological problems associated with simultaneous transmission of signals at different bands of frequency by preventing phase difference occurrences.

To achieve this objective, the invention is an audio and video signal cable comprising at least one at least one circular tinsel wire conductor, at least one circular solid conductor, and at least one rectangular conductor. The conductors are parallel arrayed and may be individually insulated. Tinsel wire is defined as a very thin flat conductor, or a number of very thin, flat conductors, that are all spirally wrapped together around a core material. The shape thus approximates a tube.

The conductors of the preferred embodiment may have different cross-sectional areas. The conductors may also be twisted together and the twisted conductors are all surrounded by a common insulation.

The plurality of circular solid conductors may be made of wires of different gauges and the number of circular solid conductors in a signal cable can vary depending on the contemplated strength of the signal.

The preferred embodiment is normally comprised of two or more tinsel conductors. In another embodiment, a magnet wire conductor is used instead of a tinsel wire conductor. Magnet wire is defined as a fine gauge conductor that is coated with a polymer material that serves as an insulator.

BRIEF DESCRIPTION OF THE INVENTION

These features, aspects and advantages of the present invention will become better understood with regard to the following description, appended claims and accompanying figures where:

DETAILED DESCRIPTION OF THE INVENTION

The following discussion describes in detail two embodiments of the invention and several variations of those embodiments. This discussion should not be construed, however, as limiting the invention to those particular embodiments. Practitioners skilled in the art will recognize numerous other embodiments as well.

Figure 1:
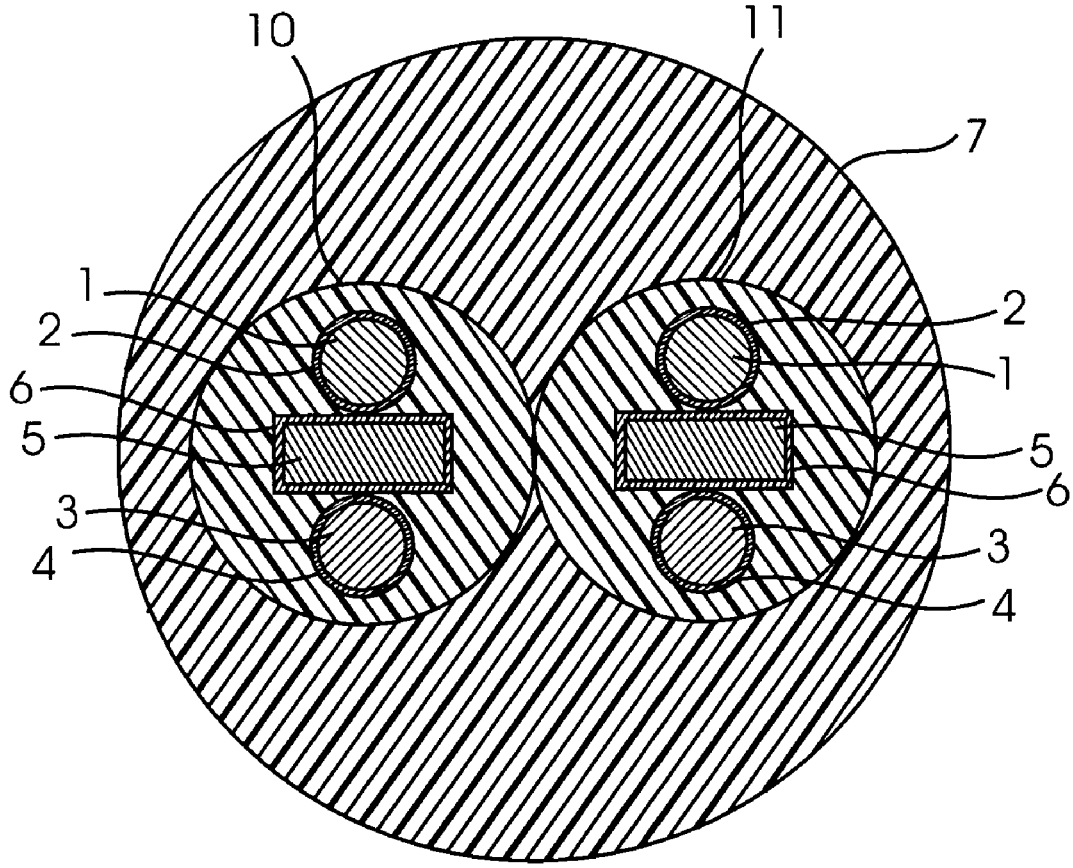
FIG. 1 is a cross-sectional drawing of the first embodiment of the invention herein.

Referring to FIG. 1, the cross-sectional drawing of the preferred embodiment of the invention, tinsel 1 and its insulation 2 comprise one conductor, also known as a core, a circular solid conductor 3 and its insulation 4 comprise another conductor, and a rectangular conductor 5 and its insulation 6 comprise another conductor. The conductors within the cable are individually insulated in this embodiment as way of example, but the cable of this invention is equally functional if the conductors are not individually insulated. Insulation 7 surrounds all of the conductors within the cable of the invention.

The circular solid conductors can be of varying gauges. Further, the conductors utilized in the cable of the invention can be of varying geometric shapes and cross-sectional areas. The quantity of conductors in a cable can be chosen according to the signal that the cable is expected to carry. Preferably, at least two tinsel conductors 1, at least two circular solid conductors 3, and at least one rectangular conductors 5 are used. However, the number of conductors can vary from cable to cable, as needed to accommodate signal strength.

As shown in FIG. 1, the audio video signal cable contains a signal 10 and a return 11. In the preferred embodiment, the cross-sectional areas of the signal 10 and return 11 are identical, but can be different if the shield is to be used as the return. This may be desired to reduce cost or the overall size of the cable. In one embodiment of the invention, the return 11 can also be a shield, which is a construction for audio and video cables known in the art.

In one embodiment of the invention, the tinsel conductor 1 is replaced by enamel-covered wires. Preferably, at least two enamel-covered wires are used. Enamel covered wire is a high purity, high conductivity conductor that has been found to be more efficient for high frequencies than other types of conductors. Typically such wire has several layers of insulating enamel. Since the insulating enamel on the surface of enamel covered wire is very thin, wire insulation outer diameter can be substantially reduced, especially if numerous enamel covered wires are required.

Tinsel is generally wound around numerous nylon, Kevlar, Polyester, Polypropylene, Polyethylene, or cotton fibers to form a very narrow conductor. Since tinsel has a fibrous center, it has been found to have increased tensile strength and bending resistance when compared to conventional conductors. The tinsel interlacing approach of the invention provides greater distance between conductors, enabling a larger surface area that reduces negative aspects of skin effect and benefits high frequency transmission.

Figure 2:
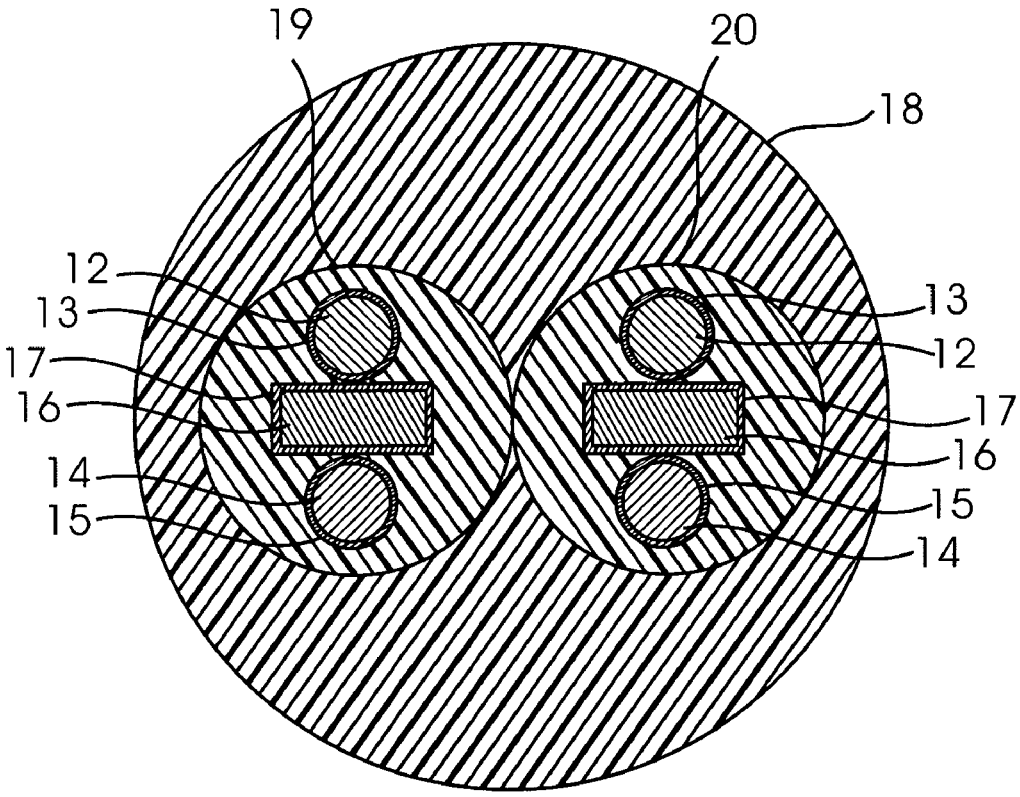
FIG. 2 is a cross-sectional drawing of the second embodiment of the invention herein.

Referring to FIG. 2, illustrating a cross-sectional drawing of another embodiment of the invention, magnet wire 12 and its insulation 13 comprise one conductor, a circular solid conductor 14 and its insulation 15 comprise another conductor, and a rectangular flat conductor 16 and its insulation 17 comprise another conductor. The conductors within the cable are individually insulated in this embodiment by way of example, but the cable of this invention is equally functional if the conductors are not individually insulated. Insulation 18 surrounds all of the conductors within the cable.

As in the preferred embodiment, the circular solid conductors can be of varying gauges. Further, the conductors utilized in the cable of the invention should be of varying geometric shapes as specified. The quantity of conductors in a cable can be chosen according to the signal that the cable is expected to carry. Thus, the number of conductors could vary from cable to cable, as required by signal strength.

As shown in FIG. 2, the audio video signal cable contains a signal 19 and a return 20. The cross-sectional areas of the signal 19 and return 20 are preferably identical, but can be different if the shield is used as the return. In one embodiment of the invention, the return 20 can also be a shield.

In the invention herein, the word conductor refers to any material capable of electrical conductance; various metals are most often utilized and thus any suitable metallic material can be employed for fabrication, including solid copper or multi-stranded copper wire; silver-, aluminum-, steel- or other metal-based metallic coatings; and metal alloys or other assorted admixtures; the conductor can also be a non-metallic compound material capable of conductivity.

In the invention herein, the said insulation is also known as a dielectric, referring to an appropriate material utilized for electrical cable insulation, including polyethylene, polyvinyl chloride, polypropylene, polyvinyl chloride copolymer, crosslinked polyethylene, rubber, and other materials; the many kinds of insulating materials can also be fortified by the addition of an agent such as a flame retardant and fungi proofing, etc.

Since the audio and video cable is of a multiple core design, the thickness of each conductor is preferably differentiated from core to core. It is commonly known that light gauge wire aids high frequency signal transmission and that heavy gauge wire benefits low frequency signal transmission. As such, the three types of cores of this invention are of heavy, light, and ultra light gauges to provide specific conductors for high, medium, and low frequency transmission without mutual interference.

The light gauge wires improve high frequency phase characteristics to preserve the highest fidelity and the cleanest audio quality. The separate channels for high, medium, and low frequencies in the audio and video signal cable of the invention herein are capable of remarkably efficient audio and video performance. Compared to the existent technology, the invention herein provides a multi-core audio and video cable having an extremely balanced high, medium, and low frequency response for good midrange and, furthermore, better definition.

Many modifications and variations are possible in light of the above teaching. The foregoing is a description of the preferred embodiments of the invention and has been presented for the purpose of illustration and description. It is not intended to be exhaustive and so limit the invention to the precise form disclosed.

The invention claimed is:

1. A multi-core audio and video signal cable comprising:

at least one circular tinsel wire conductor;

at least one circular solid conductor;

at least one rectangular conductor, wherein all of said conductors are parallel arrayed.

2. The cable of claim 1, wherein said at least one tinsel conductor, said at least one solid conductor and said at least one rectangular conductor each have a distinct cross-sectional area.

3. The cable of claim 2, wherein said at least one circular tinsel wire conductor, at least one circular solid conductor, and at least one rectangular conductor are covered by a shielding.

4. The cable of claim 3, wherein said shielding is surrounded by an insulation.

5. The cable of claim 1, wherein at least one of the at least one circular tinsel wire conductor, at least one circular solid conductor, and at least one rectangular conductor is individually insulated.

6. The cable of claim 1, wherein the gauge of at least one said solid conductor is different from the gauge of at least one other solid conductor.

7. The cable of claim 1, wherein said at least one circular tinsel wire conductor comprises at least two enamel covered wires.

8. The cable of claim 1, wherein said at least one rectangular conductor is a solid rectangular conductor.

9. A multi-core audio and video signal cable comprising:

at least one circular magnet wire conductor;

at least one circular solid conductor;

at least one rectangular conductor, wherein all of said conductors are parallel arrayed.

10. The cable of claim 9, wherein said at least one circular magnet wire conductor, said at least one solid conductor and said at least one rectangular conductor each have a distinct cross-sectional area.

11. The cable of claim 10, wherein said at least one circular magnet wire conductor, at least one circular solid conductor, and at least one rectangular conductor are covered by a shielding.

12. The cable of claim 11, wherein said shielding is surrounded by an insulation.

13. The cable of claim 9, wherein at least one of the at least one circular magnet wire conductor, at least one circular solid conductor and at least one rectangular conductor is individually insulated.

14. The cable of claim 9, wherein the gauge of at least one said solid conductor is different from the gauge of at least one other solid conductor.

15. The cable of claim 9, wherein said at least one circular tinsel wire conductor comprises at least two enamel covered wires.

16. The cable of claim 9, wherein said at least one rectangular conductor is a solid rectangular conductor.

* * * * *